United States Patent [19]

Timm

[11] Patent Number: 5,014,629

[45] Date of Patent: May 14, 1991

[54] PRESSURE VESSEL FOR DISPENSING MATERIALS AND METHOD FOR FILLING SAME

[75] Inventor: Ronald E. Timm, Hickory Hills, Ill.

[73] Assignee: R. E. Timm & Associates, Inc., Hindsale, Ill.

[21] Appl. No.: 874,234

[22] Filed: Jun. 13, 1986

[51] Int. Cl.[5] ..... E05G 1/00; G08B 15/02

[52] U.S. Cl. ..... 109/34; 109/29; 222/394; 222/541

[58] Field of Search ..... 109/20, 25, 29–34; 280/5 C, 5 D, 5 E; 222/394, 541

[56] References Cited

U.S. PATENT DOCUMENTS

| | | | |
|---|---|---|---|
| 2,536,263 | 1/1951 | Cellwork | 280/5 C |
| 2,663,271 | 12/1953 | Becker | 109/31 |
| 2,804,029 | 8/1957 | Fitzgerald | 109/34 |
| 3,507,229 | 4/1970 | MacDonald | 109/29 |
| 3,871,282 | 3/1975 | Rose | 109/31 |
| 4,131,214 | 12/1978 | Rogers | 280/5 D |
| 4,202,279 | 5/1980 | Rand | 109/34 |

*Primary Examiner*—Neill Wilson

*Attorney, Agent, or Firm*—Hosier & Sufrin, Ltd.

[57] ABSTRACT

A system for delivering a fluid from a puncture in a pressurized vessel and particularly for delivering an entry retardant into or adjacent a secure space.

29 Claims, 5 Drawing Sheets

40
42D
42C
42B
42A
46
44
54
60
48
62
52
50
56
58A
61
3A

FIG. 7A
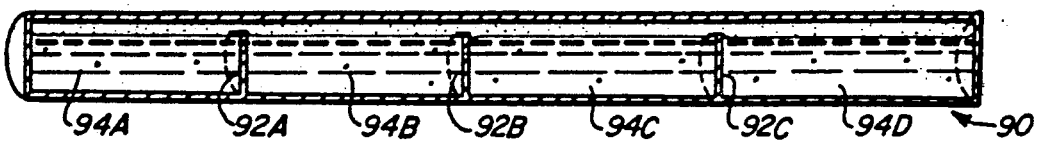
FIG. 7B
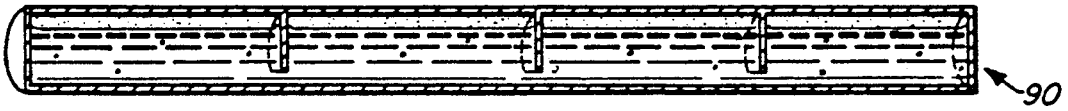
FIG. 8
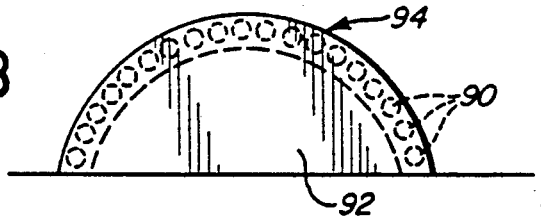
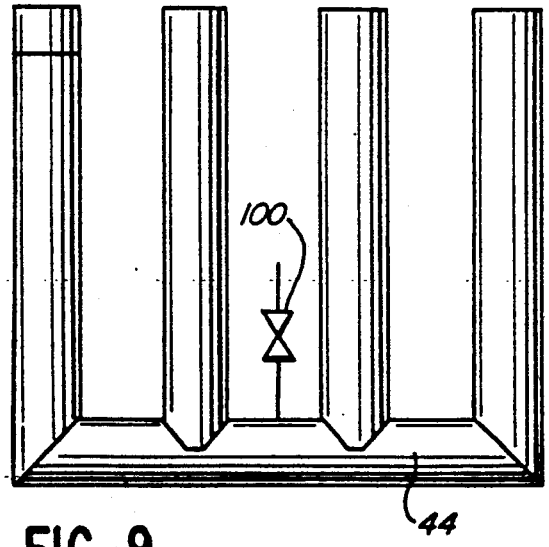
FIG. 9
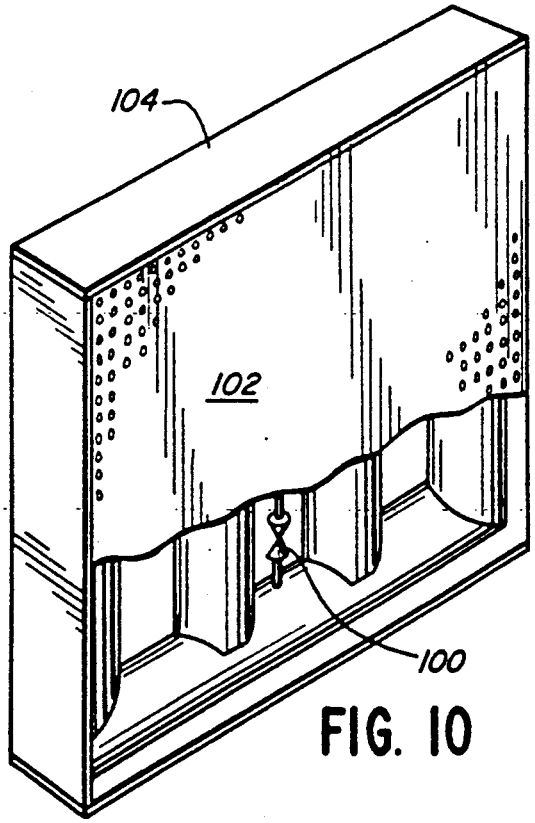
FIG. 10

PRESSURE VESSEL FOR DISPENSING MATERIALS AND METHOD FOR FILLING SAME

BACKGROUND OF THE INVENTION

This invention relates generally to the dispensing of materials from pressure vessels and, more particularly, to pressure vessels which, when punctured, dispense liquids and foams from the puncture site and to methods of filling such vessels. In an important embodiment, this invention relates to security systems for impeding unauthorized ingress to or egress from a secure space by delivering an entry retardant from a puncture site of a pressure vessel along the perimeter of the secure space or into tunnel-like entrances into such secure spaces.

There are many applications in which it is desirable to dispense a liquid or foam from a pressure vessel by simply puncturing the vessel wall to dispense the liquid or foam from the puncture site. For example, as described below, such vessels could be used in an activated barrier to protect sabotage and theft targets by dispensing a liquid or foam to impede ingress or egress across the barrier if it is breached. In fact, such vessels could be used in any application in which it is desirable to be able to reliably dispense a liquid or foam from a randomly chosen location on the vessel wall. For example, in addition to security applications of the type already mentioned, such vessels could be used to dispense materials for smothering or containing fires in response to any shrapnel or heat producing event such as the explosion of a bomb, the disintegration of a piece of machinery, or the disassembly of a nuclear reactor core.

Pressure vessels of the general type described must include an ullage containing a cover gas under pressure to force the material in the vessel through the puncture site. Unfortunately, in horizontal applications of prior art vessels, puncture of the vessels at the ullage will release the gas and thereby depressurize the system without delivering the material in the vessel. In security and many other potential applications for such vessels, this risk of disarming the system by puncturing the vessel at its ullage is not acceptable and the prior art vessels are therefore little used in such applications.

The current techniques for protecting various secure spaces, such as atomic energy facilities, embassies, military research and intelligence facilities from unauthorized ingress and egress of persons and objects include enclosing such spaces with concrete, hardened steel plate, or other passive barriers. Unfortunately such passive barriers are often inadequate to prevent or significantly delay penetration by sophisticated, well armed intruders. Thus there is a considerable need for a system, to be used either alone or in conjunction with such passive barriers, which can be activated either by force or on command to provide a higher level of protection.

One such activated system which has been suggested for delaying breach of secure spaces by intruders and thereby aiding in their capture is set forth in U.S. Pat. No. 4,202,279. This patent describes a sticky foam material in a low boiling point solvent which is maintained under pressure in its liquid form and delivered into the secure space from a single pressure vessel when there is an unauthorized attempt to gain entry by penetrating past the vessel. The resulting breach of the vessel releases the liquid foam material from the solvent to spew out of the vessel as a greatly expanded sticky foam adhering to the floor of the secure space and to the tools and the intruder attempting to use them in a "tar baby" fashion making it extremely difficult to use the tools or to walk or crawl over the foam and into or out of the secure space.

It has also been suggested to create an extended barrier by interconnecting a number of pressurized vessels containing sticky foam liquid in a low boiling point solvent as described in the above U.S. Pat. No. 4,202,279. In FIG. 1 there is illustrated such an assemblage 2 of four pressurized tanks 4A–4D each comprising a tube 6 with welded hemispherical end caps 8 and 9 and an axial, internally threaded opening in each end cap (not shown). The tanks are interconnected at the bottom openings in caps 8 through threaded couplings 10A–10D, to a lower common tubular manifold 12 which is closed off by a threaded plug 14 at one end and by a ball valve 16 coupled to the other end. Threaded couplings 18A–18D fitted to the axial openings in the top end caps 9 of the tanks interconnect the tanks to check valves 20A–20D leading to another series of threaded couplings 22A–22D and a top common tubular manifold 24. Manifold 24 has a threaded plug 26, ball valves 28 and 30 and a pressure gauge 32 coupled to valve 30.

The device of FIG. 1 is filled by first introducing an inert cover gas such as nitrogen through valve 28 and valves 20A–20D into each of the tanks, 4A–4D, while the system is maintained in a vertical position. Manifold 12 permits the pressure in tanks 4A–4D to equalize. Once the minimum pressure necessary to maintain the sticky foam in an unexpanded liquid state is obtained, typically about 100 psi., the liquid is introduced through valve 16 and manifold 12. Sufficient liquid is used to fill the tanks to a desirable level, say 80% by volume, driving the nitrogen pressure to the vicinity of 400 psi. This leaves an ullage containing roughly 400 psi nitrogen gas in the upper 20% of each tank so long as the system is maintained in a vertical position.

This prior art system has many significant drawbacks. It is expensive since it requires at least one valve for each cylinder and manifold and numerous couplings and other hardware. Its reliability is questionable and its life expectancy is short since its numerous threaded pipe connections are all potential sites for leakage. The high pressure produced on filling the system further increases the likelihood of failure at the fittings and elsewhere in the system.

In addition to the expense and questionable reliability of the system of pressurized tanks illustrated in FIG. 1, this system suffers from other even more serious drawbacks. Once a system of the type illustrated in FIG. 1 is filled, it must be transported and used in a vertical position. If the system is tilted significantly from the vertical position, the ullages at the tops of tanks 4A–4D could be shifted around in the system to an unbalanced configuration, such as that illustrated in FIG. 1A, where the sticky foam is designated at 34 and the ullage is designated at 36. Restoration of the initial distribution of the ullages in this prior art system would be extremely difficult, if not impossible.

In the unbalanced configuration of FIG. 1A, a puncture of cylinder 4D at point 38 would release all of the cover gas in the system without ejecting any sticky foam liquid. In fact a puncture of any of the other cylinders would result in release of the cover gas after ejecting only the sticky foam liquid between the puncture and the ullage in tank 4D leaving the remainder of the system unemptied. Furthermore, the prior art system depicted in FIG. 1 can be effectively used only in a vertical position. This is a serious drawback, for example, in security applications where it is necessary to protect horizontal floors and ceilings of a secure space.

Yet another problem with the prior art system of FIG. 1 is that it is extremely difficult to mount since both manifolds and each tank 4A–4D must be firmly supported in order to prevent a break at the manifold connections. This problem becomes acute when it is desired to mount the system in a movable member such as a door.

SUMMARY OF THE INVENTION

It is an object of the present invention to provide a pressure vessel which, when punctured, dispenses liquid or foam from the puncture site.

It is another object of the present invention to provide a plurality of interconnected puncturable vessels for delivering an entry retardant material under pressure, which requires minimal amounts and different types of hardware, which reduces material and fabrication expense, which is inherently more reliable, and which can be easily mounted.

It is a further object of the present invention to provide such a system of puncturable pressure vessels which can be simply and efficiently filled.

Yet another object of the present invention is to provide such a system of puncturable vessels which can be filled prior to shipment, stored in any position, and readily restored to its initial ready state.

A still further object of the present invention is to provide a system of such puncturable vessels which can be used in a horizontal position.

These and other objects of the present invention will become apparent to those skilled in the art upon consideration of the accompanying specification, claims and drawings.

The present invention primarily entails a system of interconnected pressurized vessels which, when punctured, deliver liquid from the puncture site. It will be described below in connection with one important application in which the system is employed in impeding unauthorized ingress into or egress from a secure space by delivering an entry retardant liquid into or adjacent the space. The invention is not, however, intended to be limited to this security application.

In the security application to be described, the system includes a plurality of puncturable vessels containing entry retardant liquid with each of the vessels being in communication with the remaining vessels through a common manifold. The vessels each have a discrete ullage containing a pressurized cover gas. Thus, upon puncture of one or more of the vessels, the entry retardant liquid is expelled from all of the vessels under the pressure of the independent ullages in each of the vessels. In addition, the system can be installed in both vertical and horizontal positions.

In one important embodiment, damming means are provided in each of the vessels for maintaining a ready state distribution of the ullages in each of the vessels when the system is placed in a horizontal position. This can be accomplished with baffles, as described in greater detail below, which contain the liquid within each of the vessels while permitting an even distribution of the cover gas throughout the horizontally disposed system. In fact, the unique filling method of the invention is carried out while the system is maintained in the horizontal plane, as will be described in detail below. This filling method can be used whether or not the system is provided with the described damming means.

The invention also includes an embodiment in which the system is operated by remotely activating a valve affixed to the system to release the liquid directly through a nozzle connected to the valve. In a preferred arrangement of this embodiment, where the material exits as a foam, the system is covered by a grate so that the entry retardant will pass through the openings in the grate to be dispersed over a wider area than would be covered by the foam simply spewing from the valve directly into or adjacent the secure space.

BRIEF DESCRIPTION OF THE DRAWINGS

The features of this invention which are believed to be novel are set forth with particularity in the appended claims. The invention, together with its objects and advantages, may be best understood by reference to the following description taken in conjunction with the accompanying drawings, in which like reference numerals identify like elements in the several figures and in which:

FIGS. 7A and 7B are perspective cut-away views of an alternative embodiment of the invention comprising a single tubular vessel with a series of baffles;

FIG. 8 is a diagramatic representation of a series of the tubular vessels of FIG. 7 installed in the roof of a quonset hut;

FIG. 9 is a panel generally in accordance with the panel depicted in FIG. 2 with a different weld configuration and, more importantly, arranged for remote operator activation at a pre-determined fluid release site; and FIG. 10 is a another alternative embodiment of the invention in which the panel of FIG. 9 is mounted in an enclosure having a grating on one of its sides.

DESCRIPTION OF THE PREFERRED EMBODIMENTS

The inventive apparatus and methods of the present invention will be described below in connection with the operation of the security systems illustrated in the FIGURES. The invention is not intended, however, to be limited to security applications but rather extends in alternate embodiments to pressure vessels generally which, when punctured, dispense liquids and foams from a puncture site and, in yet other alternate embodiments, to such vessels which may be activated to disperse fluids and foams from a predetermined site.

Figure 2:
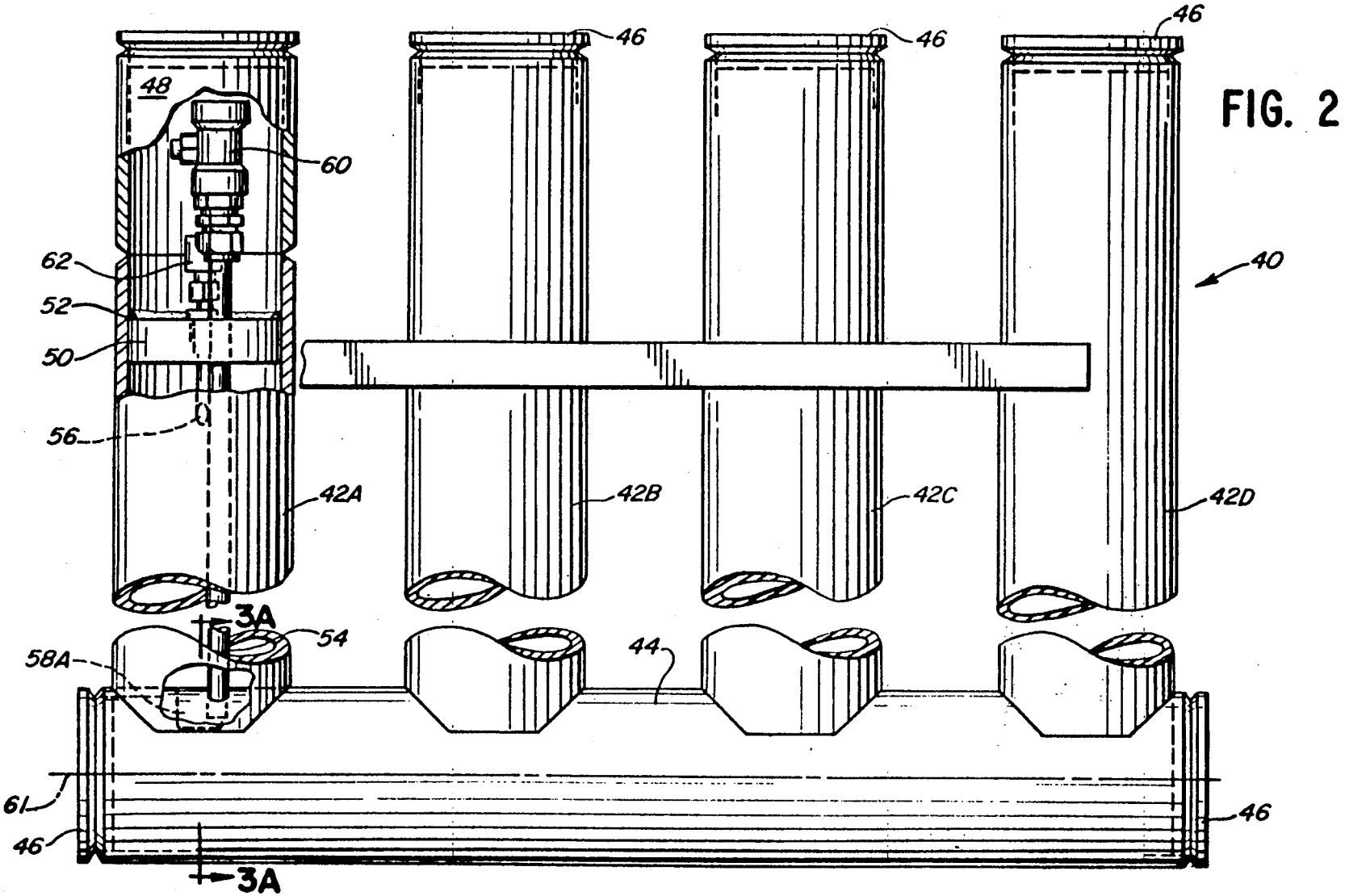
FIG. 2 is a front view of a panel of puncturable vessels in accordance with the present invention.

Turning now to FIG. 2, there is illustrated a panel 40 comprising a series of spaced tubes 42A–42D which are saddle welded at their proximal ends to a common tubular manifold 44 of like diameter. Both ends of common manifold 44 and the distal ends of tubes 42B, 42C and 42D are sealed off by welding end caps 46 in place as shown. Tube 42A, through which the panel is filled as will be described below, is foreshortened relative to tubes 42B–42D and adapted for welding an end cap 48 over the end of the tube to seal the panel after filling is complete. Tube 42A includes plug 50 tightly fit into the top of the tube and welded along its circumference at 52. A fill tube 54 and a vent tube 56 pass through plug 50 and are fitted with valving as described below.

Figure 3:
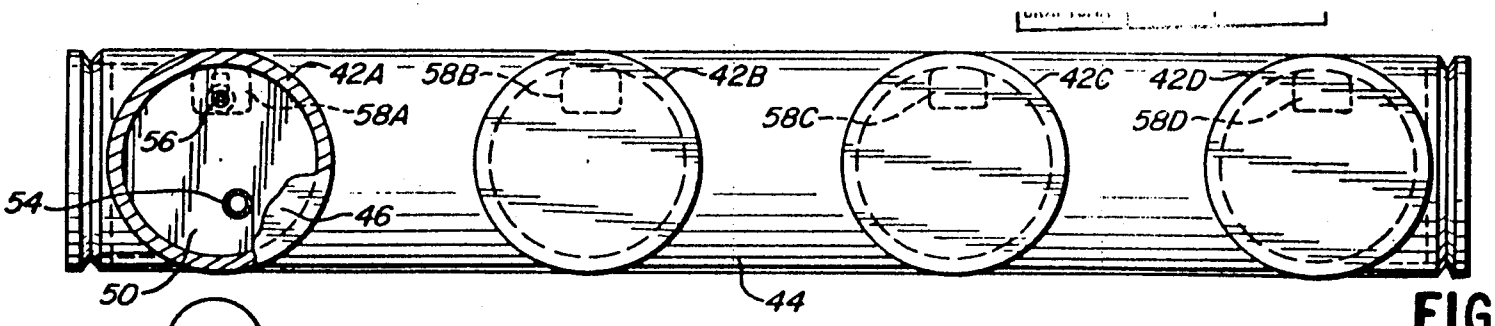
FIG. 3 is a top sectional view of the panel of the invention.
Figure 3A:
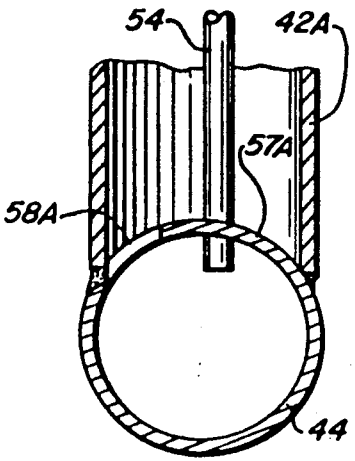
FIG. 3A is a partial side view of the panel of FIG. 2 cut-away to show the positioning of the fill tube and a baffle of the invention.

As shown best in FIGS. 3 and 3A, damming means are provided at the saddle connection of tube 42A to common manifold 44 by leaving the manifold tube intact below the saddle weld to form a baffle 57A and providing a passage 58A positioned at the edge of tube 42A for the passage of cover gas and liquid. Fill tube 54 passes through a machined opening in manifold 44, as shown. Baffles 57B–57D (not shown) are formed in each of the remaining tubes by providing openings of the same size and positioning at the respective saddle connections of each tube to the common manifold. Alternative damming means could, however, be placed in the manifold between each tube to contain the liquid in the tubes while permitting distribution of the cover gas throughout the panel, as will be explained below.

Figure 4:
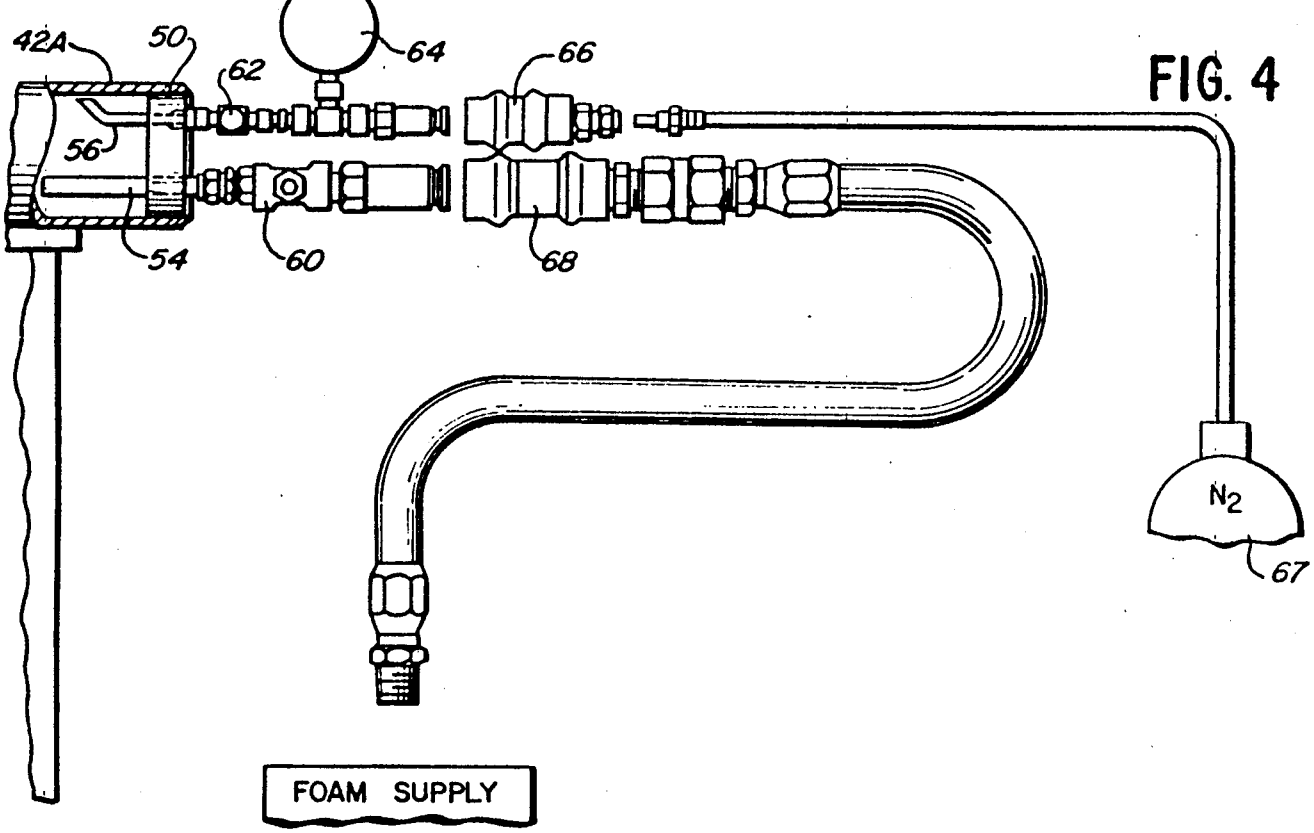
FIG. 4 is a diagramatic view of the apparatus used in filling the panel of FIG. 2.

Panel 40 is readied for filling by fitting ball valves 60 and 62 to fill and vent tubes 54 and 56, as illustrated in FIG. 4. The panel is then placed in the horizontal plane (FIG. 5, position I), a removable external gauge 64 and ball valve 66 are fitted to valve 62 and a quick disconnect valve 68 is fitted to valve 60. An inert pressurized cover gas such as nitrogen is then introduced into the system through vent tube 56 while monitoring the pressure at gauge 64. The pressure is regulated by releasing excess cover gas through ball valve 66 after the nitrogen fixture 67 is removed. When the entry retardant is sticky foam, as described below, the pressure in the system is set at about 100 psi. This is the minimum pressure required to maintain the sticky foam in liquid form.

The sticky foam liquid is then introduced into the system through valve 60 and fill tube 54 to fill the system to about a 50% level, which is reflected by a 200 psi reading on gauge 64. As the liquid exits fill tube 54, it fills manifold 44 and then spills through passages 58A–58D into each of tubes 42A–42D. The excess pressure is then relieved through valve 66 to return the system to the desired 100 psi level. This operation of back filling and relieving excess pressure is repeated until the desired level of sticky foam is introduced into the system. The desired level is determined on a case-by-case basis to insure that sufficient cover gas pressure is available to expel all of the liquid in the system. In the illustrated system where the below described sticky foam is used, an 80% fill is used and the passages 58A–58D are sized and positioned relative to the opposite edge of the common manifold to achieve a uniform fill level across the manifold and vessels at this level. A final pressure of 200 psi is left in the system to insure that all of the liquid foam will be expelled from the system.

When the desired fill has been achieved, valves 60 and 62 are closed, valves 66 and 68, and gauge 64 and associated piping are removed, and cover 48 is welded over the end of tube 42A to effectively seal the entire system.

Figure 5:
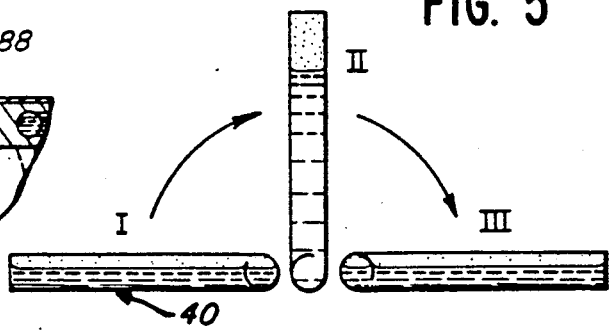
FIG. 5 is a diagramatic representation of the filling method of the invention.

Then, as illustrated diagramatically in FIG. 5, panel 40 is erected 90° from the horizontal plane (Position I) to the vertical plane (Position II) by revolving it about its horizontal axis 61 (FIG. 2). When the panel is erected to the vertical plane in this way, the sticky foam liquid flows into the lower 80% of each vessel and 100% of manifold 44 with the remaining 20% of each vessel containing a discrete independent nitrogen-containing ullage. Of course, the same result would obtain without baffles 46A–46D, (so long as there is an unobstructed path for the cover gas to pass between the tubes and the manifold when the system is in the horizontal position. However, in the absence of the baffles, the panels could be used only in vertical installation applications, as explained below.

Figure 1:
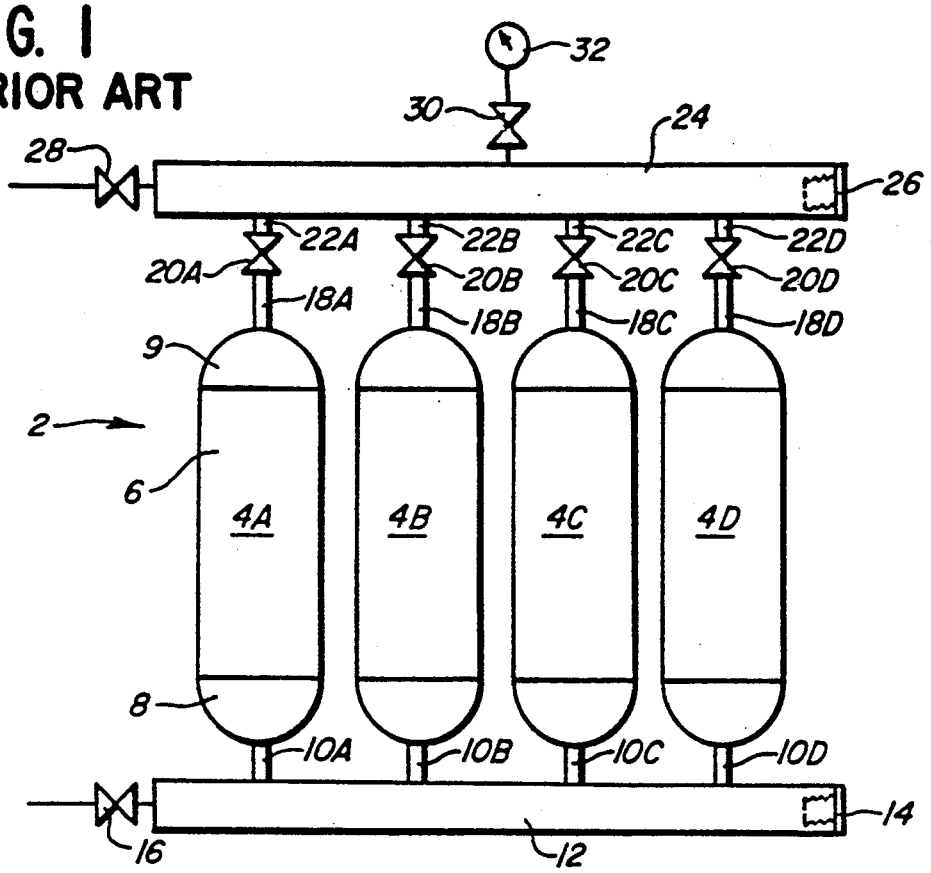
FIG. 1 PRIOR ART
FIGS. 1 and 1A are plan views of a foam dispensing system in accordance with the prior art.
Figure 1A:
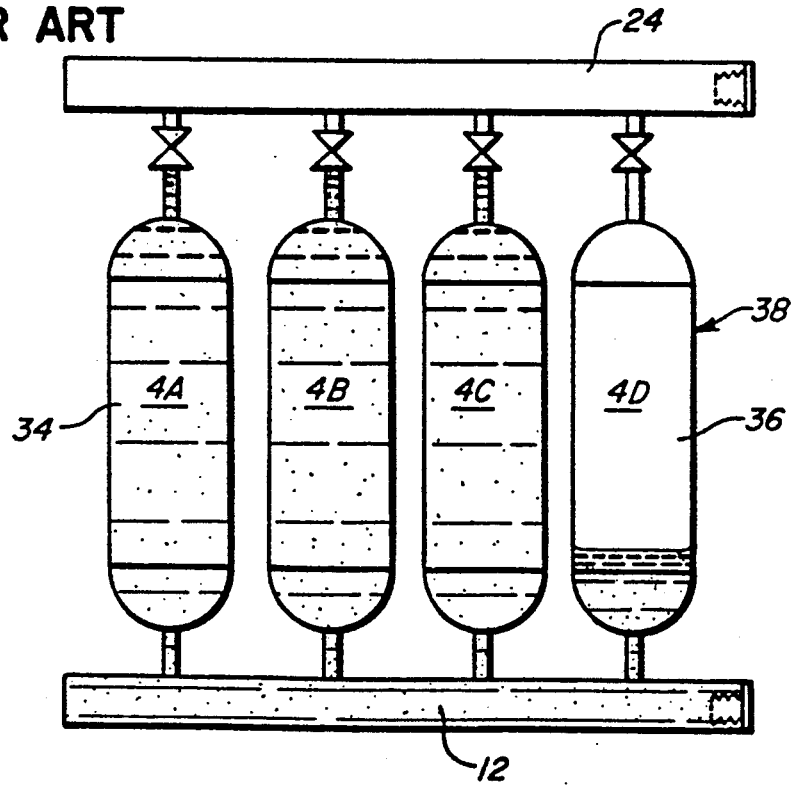
FIG. 1A PRIOR ART

Panel 40 can be shipped in any attitude without concern about losing the separation of the ullages in each of the vessels, as illustrated in FIG. 1A with respect to the prior art device depicted there. If the ullage separation is lost in panel 40, due to the positioning of the original ready state distribution of the ullages at the distal ends of the vessels can be readily reestablished by simply leveling the panel in the the horizontal plane, (FIG. 5, Position I) and again erecting the panel 90° to the vertical plane (FIG. 5, Position II). Again, this result obtains with or without baffling by leaving the openings between the tubes and the manifold entirely open since this would provide an unobstructed path for the cover gas to pass between the tubes and the manifold when the system is in its horizontal position. However, where baffling is present the panel must be oriented in Position I with passages 58A–58D at the top of each tube before erecting the system to the vertical since otherwise the desired gas redistribution to the ready state will be blocked by the baffling.

Panels comprising interconnected vessels configured and filled in accordance with the present invention can be disposed vertically in walls and doors to impede unauthorized access to secure spaces or to entrances to secure spaces through such vertical barriers. Such panels can also be disposed in ceilings and floors of secure spaces or passages to secure spaces to impede unauthorized access from above and below such areas.

In order to use the panels in the horizontal plane, it is merely necessary to rotate the baffled panels of FIG. 2 another 90° (FIG. 5, Position III) about pivot axis 61. When this is done, the pressurized cover gas is manifolded along the top of each vessel 42A–42D behind its respective baffle as shown diagramatically in FIG. 5. Since the liquid in each tube is dammed behind its respective baffle, the ullages are kept apart from each other. Accordingly, a puncture of one of the vessels at its ullage will not release the remaining ullages in the system. The gas in the remaining ullages will therefore drive the liquid through the puncture site after loss of the gas in the punctured vessel. If the ullages were interconnected or able to "see" each other, as would be the case if the prior art system depicted in FIGS. 1 and 1A were erected in a horizontal plane, a puncture along the top of any of the vessels would depressurize and therefore disarm the entire system before all of the liquid was dispensed.

Figure 6:
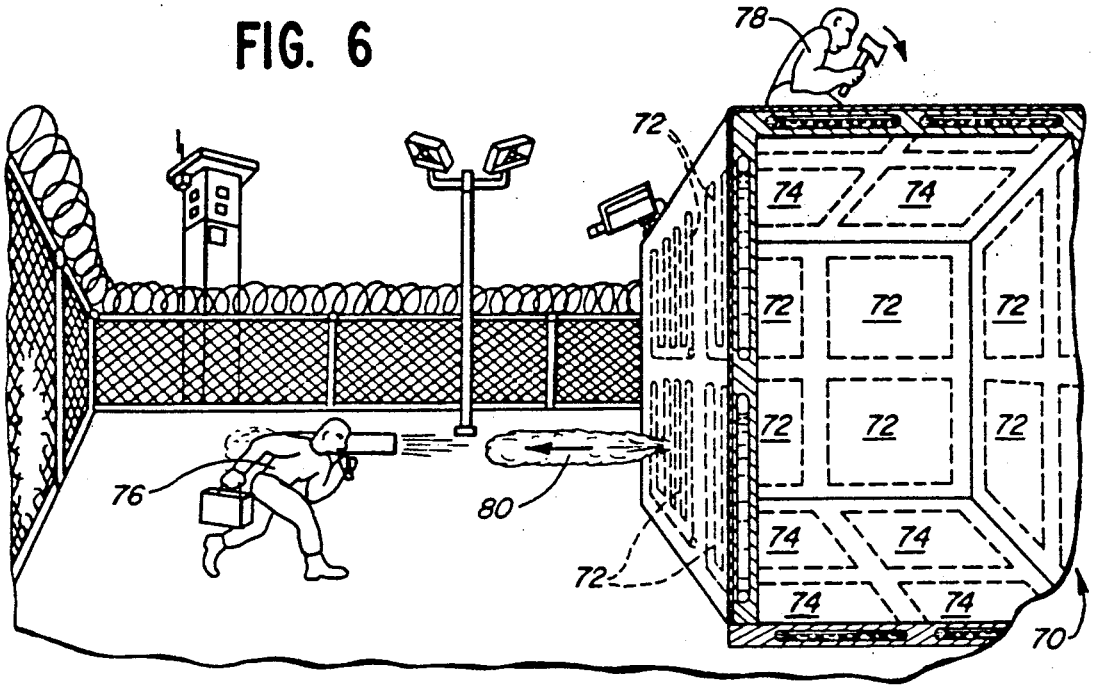
FIG. 6 is a partial prospective view of a secure space enclosed with the panels of the present invention showing two intruders attempting to breach the space.
Figure 6A:
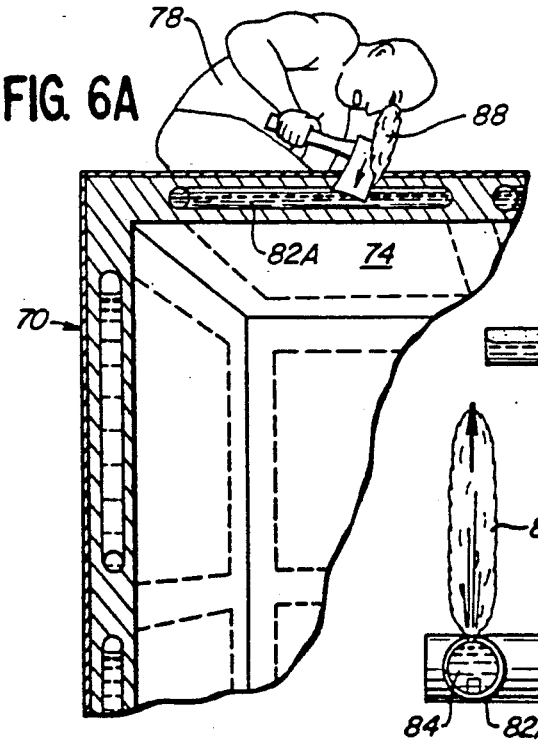
FIG. 6A is a partial exploded view of FIG. 6 showing one of the intruders attempting to breach the secure space.
Figure 6B:
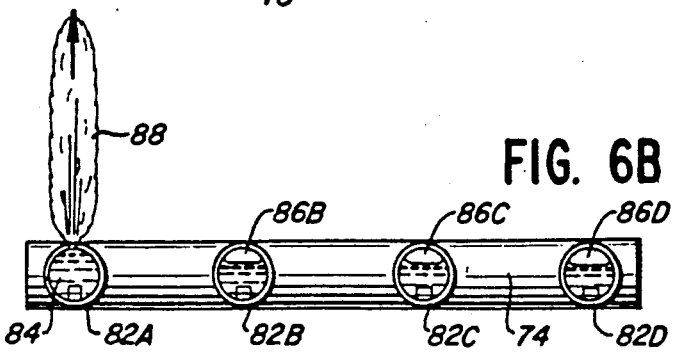
FIG. 6B is an end view of the horizontal panel breached by the intruder of FIG. 6A showing liquid foam spewing forth from the panel breach.

The operation of the panels when installed about a secure space in the horizontal and vertical positions is illustrated in FIGS. 6, 6A and 6B. Turning first to FIG. 6, there is illustrated a secure space 70 with a series of vertical panels 72 and horizontal panels 74 which are readily strapped in place (strap mounting not shown) respectively in its vertical walls and horizontal ceiling and floor. The panels are backed with a barrier material which preclude a precision attack on either the tubes or the space between them.

Intruders 76 and 78 are shown attempting to breach the secure space with an ax and with heavy arms. A stream of sticky foam 80 is shown in FIG. 6 spewing forth from one of the panels 72 to prevent intruder 76 from advancing into the secure space. In FIG. 6A and 6B, a breached tube 82A of one of the horizontal panels 74 is shown after the cover gas in the ullage of that tube escaped to be replaced by the sticky foam liquid 84 which is flowing into tube 82A from tubes 82B–82D under the pressure of the cover gas in the ullages 86B–86D in those tubes. Sticky foam liquid 84 is emerging from the breach in the tube 82A as a stream of sticky foam 88 to thwart the continued progress of intruder 78.

In some applications such as quonset hut ammunition bunkers, where the secure space has curved contours, it is desirable to position independent pressurized vessels horizontally along that contour rather than cutting across a cord of the contour with a panel as described earlier. There is thus illustrated in FIGS. 7A and 7B another embodiment of the present invention which comprises a single tubular vessel 90, shown in a cutaway view, having a series of baffles 92A–92C defining chambers 94A–94D in the vessel.

This vessel is prepared for filling by rotating the vessel to the position of FIG. 7A with baffles 92A–92C directed upwardly and gas and liquid filling apparatus of the type illustrated in FIG. 2 attached at one end of the tube (filling apparatus not shown in FIG. 7). Thus, while the vessel is maintained in the horizontal plane, it is filled with nitrogen gas, and filled with the liquid form of the sticky foam until the desired level of liquid is present in the system. Once the tube is filled, the vessel is capped, the cap is welded in place, and the tube is rotated 180° to the position illustrated in FIG. 7B so that the baffles now project downwardly from the top of the vessel.

Thus, if a series of such tubes were installed about a quonset hut 92 as illustrated in FIG. 8 and one of the chambers 94A–94D of the tube were punctured by an intruder, only the pressurized gas of the punctured chamber would be lost. As in the earlier described embodiments of the invention, the gas in the remaining chambers would force the entry retardant liquid out through that puncture to again thwart the intruder.

While the present invention has been described in environments where it is activated by an unauthorized intruder who directly attempts to penetrate the pressurized vessels of the invention, the system may be arranged for operator or automatically controlled activation, as illustrated in FIG. 9. This figure shows a pyrotechnically activated valve 100, activateable by remote command, positioned on the manifold 44 of the panel of FIG. 2 which would release sticky foam in response to a remote command. Such an operated panel could also be used, for example, in a nuclear reactor to dispense borated foam onto reactor fuel elements. In such an application, panels or individual tubes in accordance with the present invention would be mounted above the top of the reactor. In the event of a nuclear core accident, one or more of the following would occur to release borated foam onto the reactor fuel elements to halt the reactor operation: (1) the panel would rupture due to increased gas pressure resulting from the heated environment, (2) shrapnel from disassembly of the reactor would puncture the tubes of the panel, or (3) an operator would activate the panel.

Naturally, other conventional command and automatically activated valves could be used in security and in other applications. For example, pneumatically, hydraulically and electromagnetically operated valves could be used in various applications. Also the valve may be fitted with an appropriate nozzle to direct the liquid as desired (not shown).

A guard detecting an attempted breach of the secured space protected by the valve bearing panel of FIG. 9 could activate the valve to release the sticky foam liquid in the system thereby disabling or delaying the intruder until he can be apprehended. Alternatively, the panel could be activated by a breach by the intruder or, the guard could himself shoot into the panel to stop the intruder with a stream of non-lethal liquid foam instead of a life threatening bullet.

Since it may be desirable to spread the foam over a broader area in the immediate vicinity of the panel than might be achieved through ejecting a single stream of foam through the valve, the operator activated panel may be enclosed as shown in FIG. 10 with a grating 102 on one side and solid plate 104 forming an enclosure about the panel. This grating will direct flow of the foam through the grating side of the panel thereby covering a broader area with a plurality of foam streams. Thus, the valve releases the foam to fill the enclosed panel and then escapes as a wall of foam streams through the holes in grating. When sticky foam is used in a 4′ by 4′ panel with 4″ diameter tubes, a grating or mesh with 1 inch holes has been found to be particularly desirable in this application.

The entry retardant liquid used in this system may be any liquid which can be maintained in a pressurized system and which will, upon ejection from the system, either cause an unauthorized intruder to become stuck in place, prevent the intruder from exiting by making all surfaces slippery, mark the intruder for ready apprehension or otherwise provide a liquid or foam to meet the desired security purposes. Foams are generally preferred because the volume of foam can be many times that of the liquid in the system. For example, expansion ratios of 35:1 are readily obtained. In fact, where a tunnel like entrance is being protected, the foam can be used to fill the entire tunnel and, if desired, can include fast setting agents, to form a foam block barrier.

In a preferred embodiment, the entry retardant liquid used will form a sticky foam. Such a sticky foam can be prepared by dissolving a tacky thermoplastic resin in a low boiling solvent under pressure such that when the pressure is released, the low boiling solvent vaporizes and a greatly expanded sticky foam is generated. The preparation of sticky foams of this type is described in U.S. Pat. No. 4,202,279, referred to above in the background of the invention. One commercially available product made in accordance with U.S. Pat. No. 4,202,279 is sticky foam SF283 which is presently available from the U.S. government for use by or on behalf of the U.S. government. Another useful foam can be made by reacting a polyisocyanate with a polyol. Other sticky foams can be made by adding to a basic foaming material phthalate plasticizers, polyisobutylene, high aromatic oils, rosins or terepenes.

The sticky foams can be tailored with additives to meet special requirements such as simplified cleanup by, e.g., limiting the time of the foam's stickiness or causing the foam to shrink and pull away from surfaces after a predetermined time interval. In addition, agents can be added to make the foam hot, to cause great discomfort to an intruder who is not prepared with special protection. Pungent odor agents can also be used to further discourage the unauthorized intrusion.

The system must be constructed of a material capable of withstanding the pressures seen on filling and when the system is at a ready state with a margin for safety under high temperature conditions which would, of course, increase the cover gas pressure. For example, the system could be constructed of 4 inch tubes of $\frac{1}{8}$–$\frac{1}{4}$ inch 6061 aluminum, with tubes 42A–42D (FIG. 2) spaced about 4 inches apart in the panel. Alternatively, it could be made in other sizes and spacings and of copper, steel and various plastics which exhibit the necessary pressure and temperature characteristics.

While the present invention is described above in connection with preferred or illustrative embodiments, these embodiments are not intended to be exhaustive or limiting of the invention. Rather, the invention is intended to cover any alternatives, modifications or equivalents that may be included within its sphere and scope, as defined by the appended claims.

What is claimed is:

1. A system for containing material under pressure comprising:
   - a plurality of vessels containing the material to be delivered;
   - one of the vessels comprising a common manifold interconnecting the remaining vessels;
   - a pressurized cover gas contained within the system; and
   - means, associated with said common manifold, for establishing and restoring discrete pressurized cover gas containing ullages in each of the vessels.

2. The system of claim 1 wherein:
   - said vessels are puncturable; and
   - each of the vessels has a discrete pressurized gas containing ullage,
   - whereby upon puncture of one or more of the puncturable vessels the materials will be expelled through the puncture under the pressure of the pressurized gas in the discrete pressurized gas ullages.

3. The system of claim 1 including a valve for releasing the material from the system.

4. The system of claim 3 wherein the valve is connected to the common manifold.

5. The system of claim 3 wherein the valve may be pyrotechnically activated.

6. The system of claim 3 wherein the valve may be activated from a remote location.

7. The system of claim 1 wherein the vessels interconnected to the common manifold are generally parallel, elongated tubes.

8. The system of claim 7 wherein the generally parallel elongated tubes are spaced about four inches apart.

9. The system of claim 1 wherein the material is an entry retardant material chosen from the group consisting of adhesive agents, slippery agents, marking agents, odor agents, blocking agents, and heating agents.

10. The system of claim 1 wherein the material is an entry retardant liquid which forms a sticky foam upon ejection from the system.

11. The system of claim 10 wherein the entry retardant liquid is a tacky thermoplastic resin dissolved in a low boiling solvent.

12. The system of claim 1 wherein said establishing means comprises, when the system is in a horizontal position, an unobstructed pathway for passage of the pressurized gas between the vessels.

13. The system of claim 1 including means for damming the pressurized gas in each of the vessels when the system is in a horizontal position.

14. The system of claim 1 wherein:
   - said material is a liquid which forms a foam when released from the system;
   - said system is contained within an enclosure having perforations in at least one of its walls,
   - whereby upon release of the liquid from the system, the foam will fill the enclosure and then issue forth from the perforations.

15. A system for containing material under pressure comprising:
   - a plurality of vessels containing the material to be delivered;
   - one of the vessels comprising a common manifold interconnecting the remaining vessels;
   - a pressurized cover gas contained within the system;
   - means for establishing discrete pressurized cover gas containing ullages in each of the vessels; and
   - means for damming the pressurized gas in each of the vessels when the system is in a horizontal position.

16. The system of claim 15 wherein said damming means comprises a series of baffles at the point of interconnection of each of the vessels to the common manifold, said baffles extending downwardly across the opening of each vessel into the manifold.

17. A system for containing material under pressure comprising:
   - a plurality of vessels containing the material to be delivered;
   - one of the vessels comprising a common manifold interconnecting the remaining vessels;
   - a pressurized cover gas contained within the system; and
   - means for establishing discrete pressurized cover gas containing ullages in each of the vessels, said
   - establishing means comprising, when said system is in a horizontal position, an unobstructed pathway for passage of the pressurized gas between the vessels.

18. The system of claim 17 wherein one of the vessels carries valving for filling the material and the pressurized gas into the system and a cap for sealing the valving within the system after filling is completed.

19. The system of claim 17 wherein:
   - said vessels are puncturable; and
   - each of the vessels has a discrete pressurized gas containing ullage,
   - whereby upon puncture of one or more of the puncturable vessels the material will be expelled through the puncture under the pressure of the pressurized gas in the discrete pressurized gas ullages.

20. The system of claim 17 including a valve for releasing the material from the system.

21. The system of claim 20 wherein the valve is connected to the common manifold.

22. The system of claim 17 wherein the material is an entry retardant material chosen from the group consisting of adhesive agents, slippery agents, marking agents, odor agents, blocking agents, and heating agents.

23. The system of claim 17 wherein the material is an entry retardant liquid which forms a sticky foam upon ejection from the system.

24. The system of claim 23 wherein the entry retardant liquid is a tacky thermoplastic resin dissolved in a low boiling solvent.

25. A secure space comprising an enclosure having a plurality of generally vertically disposed entry retarding panels mounted in or adjacent vertical portions of the space, said panels each comprising:

a plurality of puncturable vessels containing an entry retardant material;

one of the puncturable vessels comprising a common manifold interconnecting the remaining puncturable vessels;

a pressurized cover gas contained within the system; and means for establishing discrete pressurized gas containing ullages in each of the vessels, said establishing means comprising, when said system is in a horizontal position, an unobstructed pathway for passage of the pressurized gas between the vessels, whereby upon puncture of one or more of the vessels the entry retardant material will be expelled through the puncture under the pressure of the pressurized gas to impede ingress into or egress from the secure space.

26. A secure space comprising an enclosure having a plurality of generally horizontally disposed entry retarding panels mounted in or adjacent horizontal portions of the enclosure, said panels each comprising:

a plurality of puncturable vessels containing an entry retardant material;

one of the puncturable vessels comprising a common manifold interconnecting the remaining puncturable vessels;

a pressurized cover gas contained within the system;

means for establishing discrete pressurized gas containing ullages in each of the vessels; and means for damming the pressurized gas in each of the vessels when each of the vessels of the system is in a horizontal position;

whereby upon puncture of one or more of the vessels the entry retardant material will be expelled through the puncture under the pressure of the pressurized gas to impede ingress into or egress from the secure space.

27. A device for containing and delivering material under pressure comprising:

a puncturable tubular vessel having at least one downwardly directed diametrically disposed baffle defining at least two adjacent chambers in the tubular vessel;

the baffle being spaced from the bottom of the tubular vessel to establish a passage between the chambers;

a pressurized cover gas disposed along the top of each of the chambers; and the material to be contained and delivered disposed along the bottom of the vessel and being present in an amount sufficient to cover the passage between the chambers;

whereby upon puncture of one or more of the chambers, the material will be expelled through the puncture under the pressure of the pressurized gas in the remaining chambers.

28. The device of claim 27 wherein said material is an entry retardant material.

29. A secure space comprising an enclosure having disposed about its perimeter a plurality of pressurized tubes, said tubes each comprising:

a puncturable tubular vessel having at least one downwardly directed diametrically disposed baffled defining at least two adjacent chambers in the tubular vessel;

the baffle being spaced from the bottom of the tubular vessel to establish a passage between the chambers;

a pressurized cover gas disposed along the top of each of the chambers; and an entry retardant material to be contained and delivered disposed along the bottom of the vessel and being present in an amount sufficient to cover the passage between the chambers, whereby upon puncture of one or more of the chambers, the entry retardant material will be expelled through the puncture under the pressure of the pressurized gas in the remaining chambers to impede ingress into or egress from the secure space.

* * * * *